US011400510B2

(12) United States Patent
Terano et al.

(10) Patent No.: US 11,400,510 B2
(45) Date of Patent: Aug. 2, 2022

(54) DEVICE FOR MANUFACTURING FINS AND METHOD FOR MANUFACTURING FINS

(71) Applicant: Mitsubishi Electric Corporation, Tokyo (JP)

(72) Inventors: Atsushi Terano, Tokyo (JP); Nobuaki Miyake, Tokyo (JP); Tomohiko Takahashi, Tokyo (JP); Fumihiko Kusano, Tokyo (JP); Kazuyoshi Takayama, Tokyo (JP); Hiroshi Kinoshita, Tokyo (JP); Junichi Ono, Tokyo (JP); Takuya Ogura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 38 days.

(21) Appl. No.: 16/954,689

(22) PCT Filed: Dec. 19, 2018

(86) PCT No.: PCT/JP2018/046778
§ 371 (c)(1),
(2) Date: Jun. 17, 2020

(87) PCT Pub. No.: WO2019/131377
PCT Pub. Date: Jul. 4, 2019

(65) Prior Publication Data

US 2020/0353532 A1 Nov. 12, 2020

(30) Foreign Application Priority Data

Dec. 26, 2017 (JP) ..... JP2017-249159

(51) Int. Cl.
*B21D 53/08* (2006.01)
*B21D 43/28* (2006.01)
*B21D 53/02* (2006.01)

(52) U.S. Cl.
CPC ..... *B21D 53/08* (2013.01); *B21D 43/28* (2013.01); *B21D 53/022* (2013.01); *Y10T 29/53113* (2015.01)

(58) Field of Classification Search
CPC ..... B21D 53/022; B21D 53/04; B21D 53/08; Y10T 29/53113
See application file for complete search history.

(56) References Cited

U.S. PATENT DOCUMENTS 2,327,103 A * 8/1943 Harrye ..... B23D 31/02 83/94
2,836,018 A * 5/1958 Key ..... B26D 1/00 451/58

(Continued)

FOREIGN PATENT DOCUMENTS

JP 2002228379 A 8/2002
JP 2014039935 A 3/2014

(Continued)

OTHER PUBLICATIONS

Office Action dated Jun. 7, 2021, issued in corresponding Chinese Patent Application No. 201880081322. X, 18 pages including 11 pages of English translation.

(Continued)

*Primary Examiner* — Jason L Vaughan
(74) *Attorney, Agent, or Firm* — Buchanan Ingersoll & Rooney PC

(57) ABSTRACT

A fin manufacturing apparatus includes: a progressive pressing device that forms, by forming in a metal plate having thermal conductivity a plurality of openings for tube-insertion and a plurality of slits while leaving uncut portions, strips that each have openings along a longitudinal direction of the strip and are partially coupled to each other in a width direction; an inter-row cutting device that separates, by cutting the portions via which the strips are coupled to each (Continued)

other, the strips such that each strip has a width of the fin; a cutoff device that cuts the separated strips to a predetermined length; and a guiding device between the inter-row cutting device and an inter-row slit device that guides and supplies, to the inter-row cutting device, the strips that are partially coupled to each other in the width direction, are arranged in the width direction, and are conveyed in the longitudinal direction.

17 Claims, 10 Drawing Sheets

(56) References Cited

U.S. PATENT DOCUMENTS

| | | | | |
|---|---|---|---|---|
| 3,722,251 | A * | 3/1973 | Withrow | B21D 43/287 72/294 |
| 3,839,974 | A * | 10/1974 | Freres | B21D 43/287 72/185 |
| 5,349,841 | A * | 9/1994 | Honma | B21D 43/12 72/333 |
| 9,009,953 | B2 * | 4/2015 | Ueda | B21D 53/022 29/727 |
| 9,079,277 | B2 * | 7/2015 | Karasawa | B21D 53/022 |
| 9,089,935 | B2 * | 7/2015 | Karasawa | B21D 53/022 |
| 9,120,191 | B2 * | 9/2015 | Karasawa | B23P 15/26 |
| 9,192,978 | B2 * | 11/2015 | Baba | B21D 53/022 |
| 9,199,346 | B2 * | 12/2015 | Karasawa | B21D 53/022 |
| 9,259,776 | B2 * | 2/2016 | Morishita | B21D 53/022 |
| 9,816,761 | B2 * | 11/2017 | Suzuki | B21D 53/085 |
| 9,987,673 | B2 * | 6/2018 | Karasawa | B21D 28/002 |
| 10,946,433 | B2 * | 3/2021 | Nishizawa | B21D 53/08 |
| 2002/0125000 | A1 | 9/2002 | Nozaki et al. | |
| 2014/0053384 | A1 | 2/2014 | Karasawa et al. | |
| 2014/0060142 | A1 | 3/2014 | Karasawa et al. | |
| 2014/0123480 | A1 * | 5/2014 | Morishita | B21D 53/022 29/727 |
| 2015/0114613 | A1 | 4/2015 | Suzuki et al. | |
| 2019/0106285 | A1 * | 4/2019 | Nishizawa | B65H 20/22 |

FOREIGN PATENT DOCUMENTS

| | | | |
|---|---|---|---|
| JP | 2014046329 | A | 3/2014 |
| WO | 2014002147 | A1 | 1/2014 |

OTHER PUBLICATIONS

International Search Report (PCT/ISA/210) dated Mar. 5, 2019, by the Japan Patent Office as the International Searching Authority for International Application No. PCT/JP2018/046778.

* cited by examiner

DEVICE FOR MANUFACTURING FINS AND METHOD FOR MANUFACTURING FINS

TECHNICAL FIELD

The present disclosure relates to a fin manufacturing apparatus and a fin manufacturing method.

BACKGROUND ART

Patent Literature 1 discloses a fin manufacturing apparatus for manufacturing flattened tube fins that are used, for example, in a heat exchanger. This manufacturing apparatus includes a press device, an inter-row slit device, a cutoff device, and a guide. The press device presses a thin metal plate to form, in the thin metal plate, cutaway portions for insertion of the flattened tubes. The inter-row slit device forms slits on the thin metal plate in which the cutaway portions are formed, thereby forming from the thin metal plate a plurality of strips arranged in the row direction. The cutoff device cuts each of the plurality of strips to a predetermined length. The guide is disposed between the inter-row slit device and the cutoff device and supplies the strips formed by the inter-row slit device to the cutoff device in a state in which the strips are separated from one another.

CITATION LIST

Patent Literature

Patent Literature 1: Unexamined Japanese Patent Application Publication No. 2014-46329

SUMMARY OF INVENTION

Technical Problem

Solution to Problem

Each of the strips formed by the inter-row slit device has an elongated shape, and thus has a relatively narrow width. This leads to lower rigidity of the strips. Furthermore, employing a configuration in which the openings for insertion of the flattened tubes open on one lateral side of each fin leads to a comb-like structure of the fin, thereby increasing the probability that the strips become caught during conveyance. This increases the probability that the strips curve and warp during conveyance by the guide and the probability that erroneous feeding by the guide occurs. This increases the probability that variance in the length occurs when the cutoff device cuts the strips to the predetermined length. Thus, the manufacturing device disclosed in Patent Literature 1 has difficulty in manufacturing high-quality fins.

The present disclosure is made in view of the above-describe circumstances, and an objective of the present disclosure is to provide a fin manufacturing apparatus and a fin manufacturing method that lower the probability of occurrence of the erroneous feeding and enable manufacturing of high-quality fins.

Advantageous Effects of Invention

To achieve the aforementioned objective, a fin manufacturing apparatus according to the present disclosure is a fin manufacturing apparatus for manufacturing fins for attachment to a tube provided with a refrigerant path and includes a first cutting device, a second cutting device, a cutoff device, and a guiding device. The first cutting device forms, by forming in a plate body having thermal conductivity a plurality of openings for tube-insertion and a plurality of slits while leaving uncut portions, strips that each have openings of the plurality of openings along a longitudinal direction of the strip and are partially coupled to each other in a width direction. The second cutting device separates, by cutting the uncut portions via which the strips are coupled to each other, the strips such that each strip has a width of the fin. The cutoff device cuts the separated strips that each have the width of the fin to a predetermined length. The guiding device is disposed between the first cutting device and the second cutting device, and guides and supplies, to the second cutting device, the strips that are partially coupled to each other in the width direction, are arranged in the width direction, and are conveyed in the longitudinal direction.

According to the present disclosure, the strips are maintained partially coupled to each other via the uncut portions during conveyance by the guiding device from the first cutting device to the second cutting device. This allows the strips to have higher rigidity than that a single strip has, thereby lowering the probability that the strips curve and warp during conveyance in comparison to conveyance of the single strip. Thus, the fin manufacturing apparatus can achieve manufacturing of high-quality fins.

DESCRIPTION OF EMBODIMENTS

Hereinafter a flattened-tube-fin manufacturing apparatus and a flatted-tube-fin manufacturing method according to embodiments of the present disclosure are described.

Embodiment 1

Figure 1:
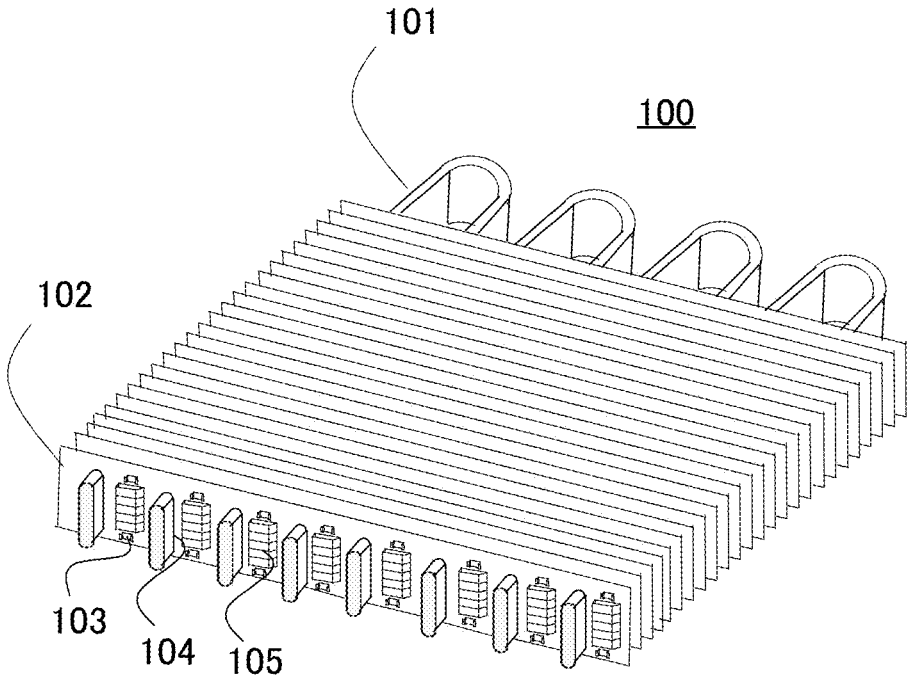
FIG. 1 is a perspective view of a heat exchanger that includes fins manufactured by a fin manufacturing apparatus according to Embodiment 1 of the present disclosure.

FIG. 1 is a perspective view of a heat exchanger that includes fins manufactured by a fin manufacturing apparatus according to Embodiment 1 of the present disclosure.

As illustrated in FIG. 1, a heat exchanger 100 is a fin-tube heat exchanger that includes a plurality of fins 102 that are stacked, and a plurality of flattened tubes 101 disposed at fixed intervals along the longitudinal direction of the fins 102 and penetrating the plurality of fins 102 in the stacking direction of the fins 102.

Refrigerant that exchanges heat with air flowing the fins 102 flows through the flattened tubes 101. The flattened tubes 101 include metal tubes forming a refrigerant flow path through which the refrigerant flows. Each of the flattened tubes 101 has a cross-sectional shape that is a flattened cartouche-like shape obtained by joining two circles of the same size by tangential straight lines.

The fins 102 are made of a thin metal plate having a rectangular parallelepiped shape. A plurality of cut-and-raised slits 105 is formed on a surface of each fin 102, and the cut-and-raised slits 105 open toward the direction in which the air flowing between the fins 102 flows, that is to say, in the short direction of the fins 102. Formation of the cut-and-raised slits 105 leads to splitting and refreshing of the thermal boundary layer on the surface of the fins 102, thereby improving the efficiency of heat exchange between air flowing between the fins 102 and each of the fins 102.

A plurality of openings 104 are formed, in each of the fins 102, at fixed intervals along the longitudinal direction of the fins 102. The openings 104 are portions into which the flattened tubes 101 are inserted, are formed along the longitudinal direction of the fins 102, and have a shape corresponding to an outline of the cross-sectional shape of the flattened tubes 101. In the present embodiment, the flattened tubes 101 have the elongated cartouche-like cross-sectional shape, and accordingly, the openings 104 are formed in the shape of the elongated cartouche.

Furthermore, in order to stack the plurality of fins 102 with a specific fin pitch, portions of the fins 102 corresponding to openings 103 are cut and raised. Each of the cut-and-raised portions contacts the adjacent fin 102, thereby achieving regular interval spacing between the fins 102.

Next, a manufacturing apparatus for, and manufacturing steps of, manufacturing the fins 102 included in the heat exchanger 100 having the above-described configuration are described.

The fins 102 in the description below have the openings 104 opening on one side in the width direction of the fins 102, which differentiates the fins 102 in the description below from those of FIG. 1. That is to say, each of the fins 102 in the description below have a comb-like structure.

Figure 2:
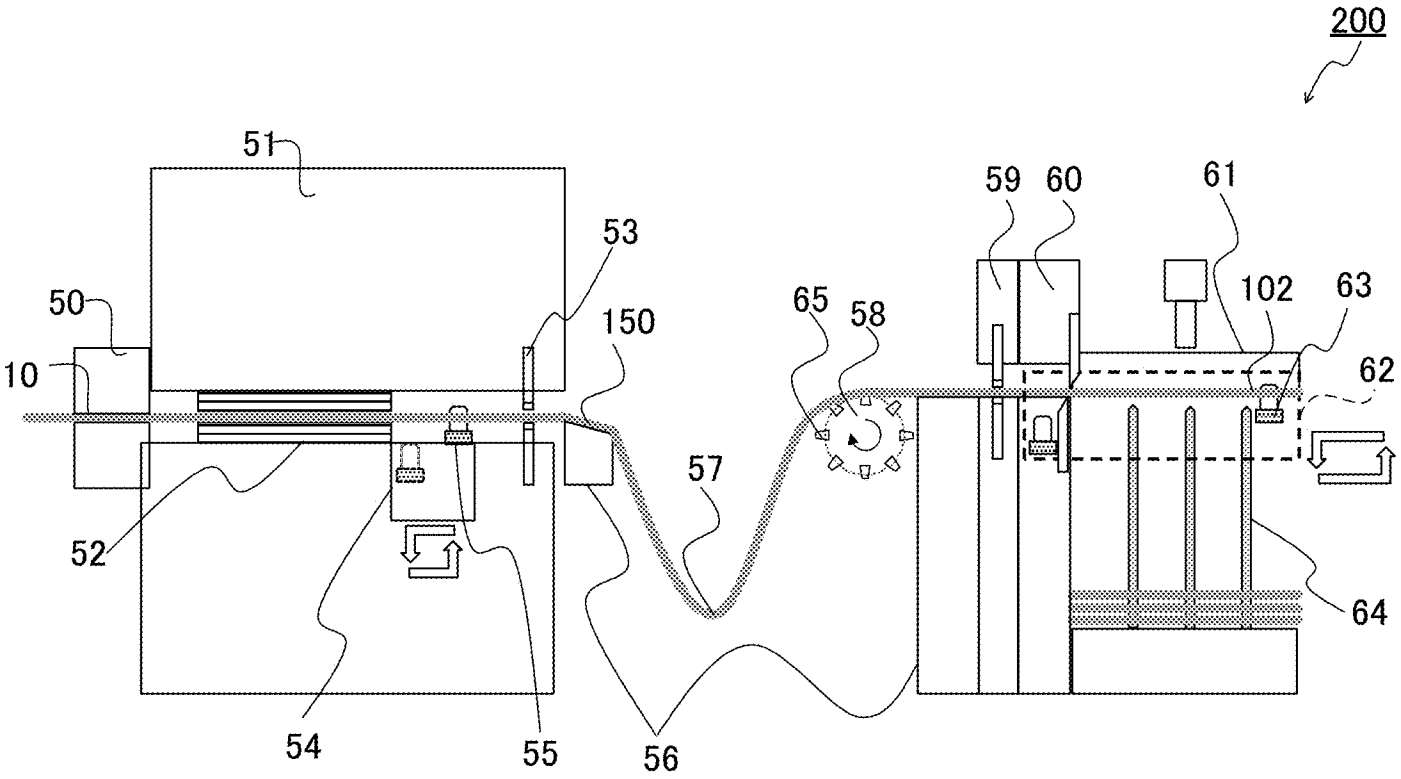
FIG. 2 is an overall view of the fin manufacturing apparatus according to Embodiment 1 of the present disclosure.

FIG. 2 is an overall view of a fin manufacturing apparatus 200 according to Embodiment 1.

As illustrated in FIG. 2, a fin manufacturing apparatus 200 includes: an NC feeder 50 that supplies a metal plate 10 that is a plate workpiece having thermal conductivity; a progressive pressing device 51 that is a first cutting device for machining the metal plate 10 to form strips 150 that are partially coupled to each other; an inter-row cutting device 59 that is a second cutting device for, by cutting the strips 150, dividing and separating the strips 150 such that each strip 150 has a width of the fin 102; a cutoff device 60 that cuts the strips 150 at regular length intervals to form the fins 102; and a stacking device 61 that stacks and holds the cut strips 150. Furthermore, a guiding device 56 is disposed between the progressive pressing device 51 and the inter-row cutting device 59. The guiding device 56 guides, as a unit, the strips 150 that are partially coupled to each other, are arranged along the width direction (the row direction) of the fins 102, and are conveyed in the longitudinal direction of the fins 102.

Figure 3:
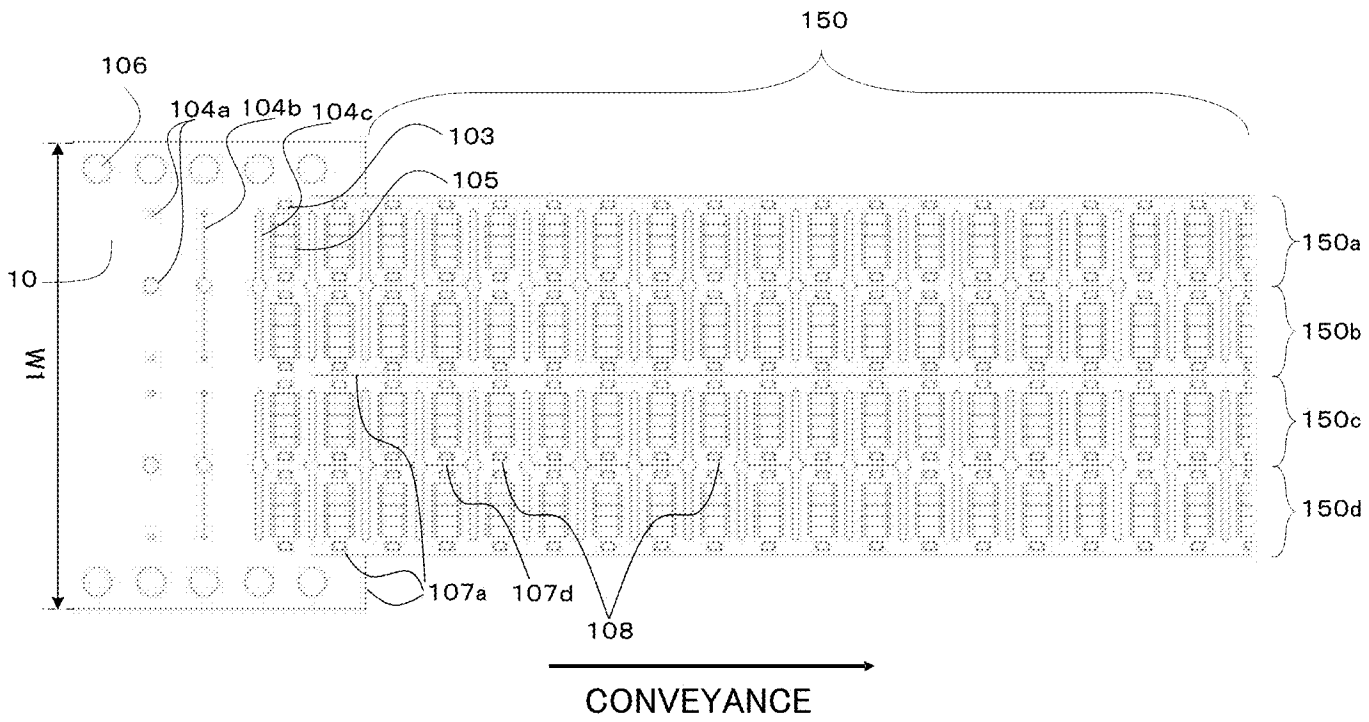
FIG. 3 is a diagram for describing pressing steps performed by a progressive pressing device in manufacturing fins of the heat exchanger by the fin manufacturing apparatus according Embodiment 1.

The metal plate 10, which is a workpiece, is made of aluminum and is an unworked elongated thin metal plate body. As illustrated in FIG. 3, the metal plate 10 is formed to have a width of W1. As illustrated in FIG. 2, the metal plate 10 is supplied by the NC feeder 50 to the fin manufacturing apparatus 200.

The numerical control (NC) feeder 50 intermittently feeds the metal plate 10 to the progressive pressing device 51 in synchrony with the operation of the progressive pressing device 51. More specifically, the NC feeder 50 includes a moving body that grips the metal plate 10 from the upper surface and the lower surface of the thin metal plate 10, and repeatedly performs, in synchrony with the operation of the progressive pressing device 51, the operation of gripping, moving to feed, releasing, and moving to return, thereby achieving intermittent feeding of the metal plate 10 to the progressive pressing device 51.

The progressive pressing device 51 includes a die device 52 and an inter-row slit device 53 along the feeding direction of the metal plate 10, in the order at the die device 52 and the inter-column slit device 53, and machines the metal plate 10 while performing intermittent feeding of the metal plate 10, thereby forming the strips 150. The progressive pressing device 51 further includes a feeding device 54 to perform the intermittent feeding of the metal plate 10.

The die device 52 performs a plurality of pressing steps by pressing the metal plate 10 using a plurality of dies. The pressing steps are performed as follows. As illustrated in FIG. 3, in a first pressing step, pilot holes 106 used for conveying the metal plate 10 that is a plate body having thermal conductivity are formed in the metal plate 10. Next, in order to form opening holes 104*c* that each have the elongated cartouche-like shape forming the openings 104 that are openings for insertion of the flattened tubes 101 that are tubes, three circular opening holes 104*a* that are to serve as end portions and central portion of the opening hole 104*c* are formed for one opening hole 104*c*. Then, in the next pressing step, opening holes 104*b* are formed so as to straddle the three circular opening holes 104*a*. Then, in the next pressing step, the vicinities of the opening holes 104*b* are cut and raised to form the opening holes 104*c* each having the elongated cartouche-like shape. Then, in the next pressing step, the cut-and-raised slits 105 and the openings 103 are formed. The steps may be performed in parallel or in tandem. The die device 52 is an example of an opening forming device that serves as a structural element of the present disclosure.

The inter-row slit device 53 is a device that cuts the metal plate 10 using dies. As illustrated in FIG. 3, the inter-row slit device 53 forms slits 107*a* at cutting positions for division of the metal plate 10 into pairs of two strips, each pair having the width of two fins 102. Furthermore, the inter-row slit device 53 forms slits 107*d* at cutting positions dividing the opening holes 104*c* having the shape of an elongated hole in the direction of the short axis thereof. The inter-row slit device 53 performs cutting of the metal plate 10 as described above. In the step of forming the slits 107*d*, the inter-row slit device 53 forms uncut portions 108 on the metal plate 10 by providing an uncut timing once every several times (for example, once every 4 times as illustrated in FIG. 3). At this stage, the opening holes 104*c* correspond to openings into which the tubes 101 are inserted and that are formed at positions extending across strips partially coupled to each other in the width direction (that is, at positions extending across a pair of strips 150*a* and 150*b*, and at positions extending across a pair of strips 150*c* and 150*d*) and not extending to the outmost sides of the pair of the strips 150*a* and 150*b* or the pair of the strips 150*c* and 150*d*. The slits 107*a* and the slits 107*d* may have the width of 0. That is to say, the slits 107*a* and the slits 107*d* may be cutting lines.

The feeding device 54 of FIG. 2, in synchrony with the NC feeder 50, conveys (transports) the metal plate 10 and the strips 150. The feeding device 54 includes feed pins 55, and inserts the feed pins 55 into the pilot holes 106 of FIG. 3 formed by the die device 52 to convey the strips 150 parallel to the conveyance direction.

The progressive pressing device 51 performs the above-described machining, thereby forming on the metal plate 10 four strips 150 arranged in the width direction, that is, in the row direction, as illustrated in FIG. 3. To distinguish the four strips 150, reference signs 150*a*-150*d* are assigned to the four strips, as shown in FIG. 3. The slit 107*a* completely separates the strip 150*b* and the strip 150*c* from each other. However, the strips 150*a* and 150*b* are partially coupled to each other via the uncut portions 108, and the strips 150*c* and 150*d* are partially coupled to each other via the uncut portions 108. The opening holes 104*c* are formed in the strips 150*a* and 150*b* and the strips 150*c* and 150*d*.

Figure 4:
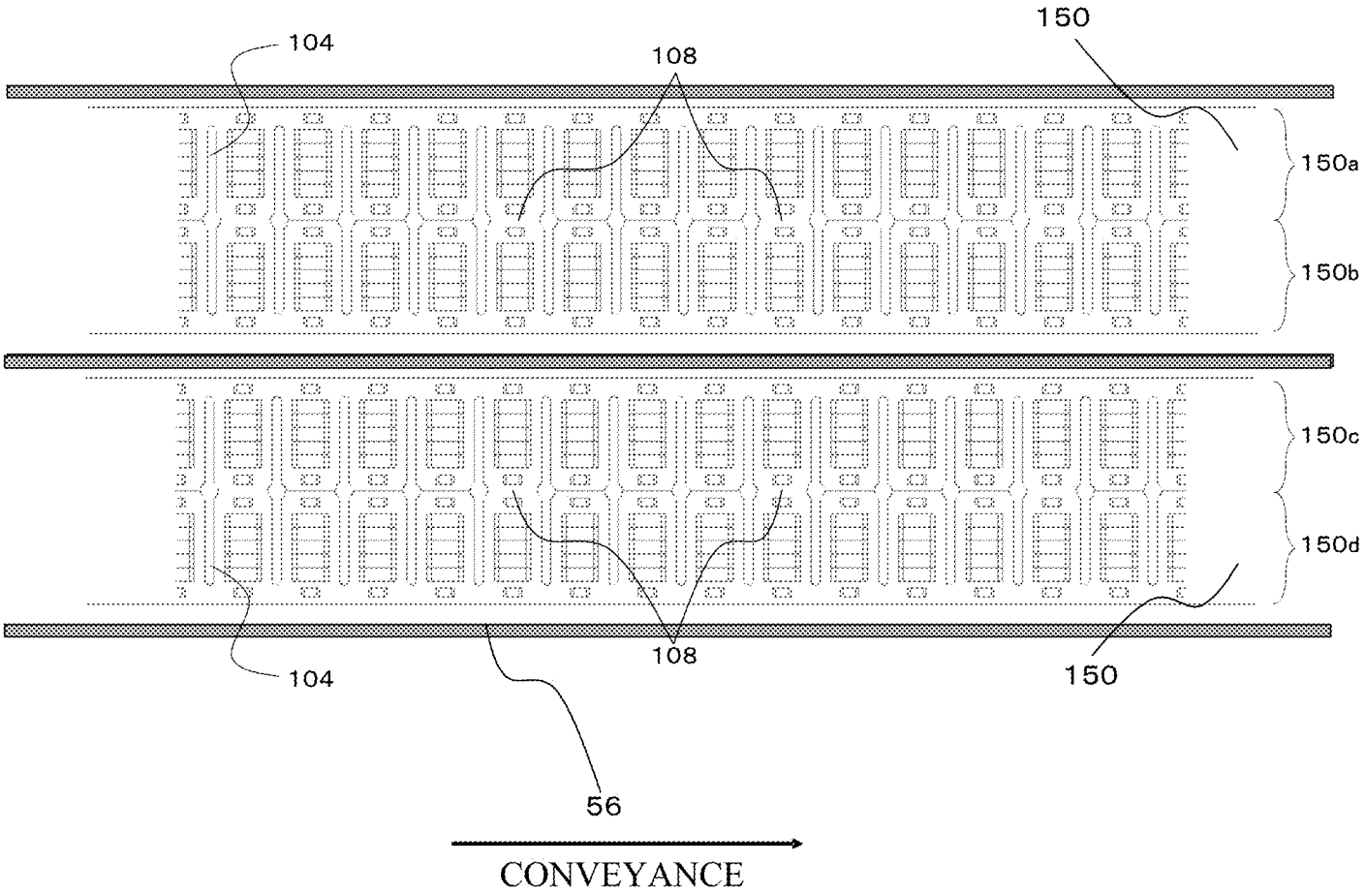
FIG. 4 is a top view of a guiding device included in the fin manufacturing apparatus according to Embodiment 1.

As illustrated in FIG. 2, the guiding device 56 is arranged as a pair of the guiding devices 56 disposed downstream of the progressive pressing device 51 to assist conveying of the strips 150. As illustrated in FIG. 4, the guiding device 56 collectively conveys the strips 150 in units of two strips partially coupled to each other. For example, when the strips 150 are provided as illustrated in FIG. 3, the guiding device 56, as illustrated in FIG. 4, performs separation of the strips 150 into a pair of two strips composed of the strip 150*a* and the strip 150*b* partially coupled to each other via the uncut portions 108 and a pair of two strips composed of the strip 150*c* and the strip 150*d* partially coupled to each other via the uncut portions 108, and conveys the two pairs while physically holding both lateral sides thereof to not allow contact between the pairs. Such configuration of the guiding device 56 prevents occurrence of deformation of the strips 150 caused by the strips 150 contacting with each other, and also prevents catching of the strips 150 caused by the strips 150 having openings on a lateral side thereof and having a comb-like structure. The slit 107*a* completely separates the pair of strips 150*a* and 150*b* from the pair of 150*c* and 150*d*, as described above.

As illustrated in FIG. 2, the guiding device 56 includes a feed roller 58. The feed roller 58 conveys the strips 150 from the inter-row slit device 53 included in the progressive pressing device 51 to the inter-row cutting device 59. The feed roller 58 includes feed pins 65 and inserts the feed pins 65 into the strips 150 (for example, into the openings 103 or the slits 104) to convey the strips 150.

The strips 150 are conveyed in a state in which both sides of a buffer portion 57 corresponding to a sag are maintained while guiding by pressing at both sides by the guiding device 56. This absorbs the differences in conveying speeds and conveying timings between the progressive pressing device 51 and devices 59-61 described below.

The inter-row cutting device 59 of FIG. 2 is disposed downstream of the guiding device 56 and cuts the uncut portions 108 of the strips 150. Thus, when the strips 150 are formed as illustrated in FIG. 4, the strips 150*a* and 150*b* are separated from each other, and the strips 150*c* and 150*d* are separated from each other. The inter-row cutting device 59 is an example of a second cutting device that serves as a structural element of the present disclosure.

The cutoff device 60 of FIG. 2 is disposed following the inter-row cutting device 59 and cuts the strips 150, divided to have the width of the fin 102, to a length of a product (that is, a length of the fin 102) to form the fins 102.

The stacking device 61 serves as a stacker of the fins 102. Specifically, the stacking device 61 performs suction-retention of the strips 150 each having an elongated shape, moves the strips 150 downward to a position at which stack bars 64 are provided after the cutoff device 60 cuts the strips 150 to a specific length to process the strips 150 into the fins 102, and stops the suction-retention to stack the processed fins 102 on the stack bars 64. Then, the fins 102 are further processed to have the shape illustrated in FIG. 1.

A feeding device 62 of FIG. 2, in synchrony with the feed roller 58, conveys the strips 150. The feeding device 62 includes feed pins 63, and inserts the feed pins 63 into the strips 150 (for example, into the openings 103 and the slits 104 of FIG. 3) to convey the strips 150.

Next, a method for manufacturing the fins 102 performed by the fin manufacturing apparatus 200 having the above-described configuration is described below with reference to FIG. 2 to FIG. 4.

The metal plate 10 having an elongated shape is wound around a hoop-shaped reel (not illustrated) and is pulled out from the reel and intermittently fed by the NC feeder 50 into the progressive pressing device 51.

The die device 52 and the inter-row slit device 53, in synchrony with the operation of intermittently feeding the metal plate 10, perform pressing operation using dies.

The die device 52 forms the plurality of pilot holes 106 illustrated in FIG. 3 every time the metal plate 10 is conveyed by 1 pitch, thereby forming the plurality of pilot holes 106 at both ends of the metal plate 10 along the conveyance direction. The feeding device 54 inserts the feed pins 55 into the pilot holes 106 formed by the die device 52 to perform the intermit feeding of the metal plate 10. The feeding device 54, in synchrony with the NC feeder 50, adjusts the timing of feeding the metal plate 10, thereby enabling stable intermit feeding.

Furthermore, the die device 52 forms, every time the metal plate 10 is conveyed, the three circular opening holes 104*a* that are to serve as the end portions and central portion of the hole 104*c* for one hole 104*c*. Then, in the next pressing step, the die device 52 forms the opening holes 104*b* by straddling the three circular opening holes 104*a* formed in the metal plate 10. Then in the next pressing step, the die device 52 cuts and raises the areas in the vicinity of the opening holes 104*b* formed in the metal plate 10, thereby forming the opening holes 104*c* having the shape of the elongated hole. Then, in the next pressing step, the die device 52 forms the cut-and-raised slits 105 and the openings 103 in the metal plate 10.

The inter-row slit device 53 cuts the metal plate 10 by forming the slits 107*a* at positions dividing the metal plate 10 into strips each having the width of two fins 102 and trimming both sides of the metal plate 10 and the slits 107*d* at positions dividing the opening holes 104*c* having the shape of the elongated hole in the direction of the short axis thereof, as illustrated in FIG. 3. In forming the slits 107*d*, the inter-row slit device 53 forms the uncut portions 108 on the metal plate 10 by providing an uncut timing once every 4 feed timings.

Performing successively and repeatedly the above-described machining in the progressive pressing device 51 enables processing of the metal plate 10 into the pair of the strips 150*a* and 150*b* coupled to each other via the uncut portions 108 and the pair of the strips 150*c* and 150*d* coupled to each other via the uncut portions 108. The slit 107*a* completely separates the pair of the strips 150*a* and 150*b* from the pair of strips 150*c* and 150*d*. The strips 150*a*, 150*b*, 150*c* and 150*d* forming the two pairs are formed such that the open ends of the openings 104 formed therein are adjacent and face one another.

The strips 150 formed by the inter-row slit device 53 are conveyed by the guiding device 56 in such a manner that both sides of each pair are held without the pairs formed by separating the strips 150 contacting each other, as illustrated in FIG. 4. This prevents the occurrence of deformation caused by the strips 150 contacting with each other.

Furthermore, as illustrated in FIG. 4, the strips 150 are arranged on the guiding device 56 such that the open ends of the openings 104 thereof are adjacent and face one another. Thus, during conveying of the strips 150, end portions of the strips 150 contact the guiding device 56. This prevents the open ends of the openings 104 from upturning, for example.

The strips 150 are guided by the guiding device 56 and conveyed, by the feed pins 65 of the feed roller 58 of FIG. 2 and the feed pins 63 of the feeding device 62, by the length of the fin 102, that is, by the product length L. This can be achieved by inserting the feed pins 65 and the feed pins 63 into either the openings 103 or the slits 104 of FIG. 3. At this stage, the separated strips 150 are positioned in the stacking device 61, and the strips 150 coupled to each other via the uncut portions 108 are positioned in the inter-row cutting device 59.

Again with reference to FIG. 2, the stacking device 61 performs, every time the strips 150 are conveyed by a predetermined length L, the suction-retention of the strips 150. The inter-row cutting device 59 cuts the uncut portions 108 provided in the strips 150 in this stable state, thereby forming separated strips 150 as two workpieces for conveyance into the stacking device 61. Further, the cutoff device 60 cuts the strips 150 to a predetermined length, thereby forming the fins 102.

The stacking device 61, in the state in which the fin 102 is suction-held, moves down to the position of the stack bars 64, and then stops the suction-retention to stack the fin 102 on the stack bars 64. The stack bars 64 may be inserted into the openings 104 of the fin 102 or may be inserted into the openings 103 of the fin 102. Repeating the above-described steps can achieve stacking of a specific number of the fins. Then, the fins 102 stacked on the stack bars 64 are conveyed to the next step.

The fin manufacturing apparatus 200 performs the above-described manufacturing steps, thereby manufacturing the fins 102 from the metal plate 10 having an elongated shape.

Here, the buffer portion 57 provided downstream of the progressive pressing device 51 allows the feed roller 58 and the feeding device 62 to have a feeding distance longer than a distance that the feeding device 54 can feed at one time. Thus, the feed roller 58 and the feeding device 62 may operate independently of the feeding device 54 or may operate in synchrony with the feeding device 54.

In the fin manufacturing apparatus 200 according to the present embodiment, the inter-row cutting device 59 is disposed near the cutoff device 60 and the stacking device 61; more specifically, the inter-row cutting device 59 is disposed immediately before the cutoff device 60. Thus, the fin manufacturing apparatus 200 can achieve conveying, to immediately before the cutoff device 60, the strips 150 including the pair of two strips 150*a* and 150*b* partially coupled to each other via the uncut portions 108 and the strips 150 including the pair of two strips 150*c* and 150*d* partially coupled to each other via the uncut portions 108. Each of the two pairs of strips 150 has rigidity higher than the rigidity that the single strip 150 has. Thus, the fin manufacturing apparatus 200 lowers the probability of occurrence of erroneous feeding of the strips 150, thereby achieving stable conveyance of the strips 150. Whereas feeding a single elongated strip that has a comb-like structure may lead to occurrence of erroneous feeding because such a strip has low rigidity, the fin manufacturing apparatus 200 has low probability of making a mistake in feeding and thus prevents occurrence of various problems such as deterioration in productivity caused by erroneous feeding. Furthermore, the strips 150 are arranged symmetrically and thus the center of gravity is located centrally, thereby preventing the strips 150 from twisting.

Furthermore, in the fin manufacturing apparatus 200, portions of the strips 150 that contact the guiding device 56 during conveyance of the strips 150 are not the openings 104 forming steps at the end portions of the fins 102 but rather are linearly-shaped end portions. This lowers frictional resistance of the strips 150 in the guiding device 56. As a result, the fin manufacturing apparatus 200 enables prevention of damage to the strips 150 caused by friction in the guiding device 56.

Embodiment 2

Figure 5:
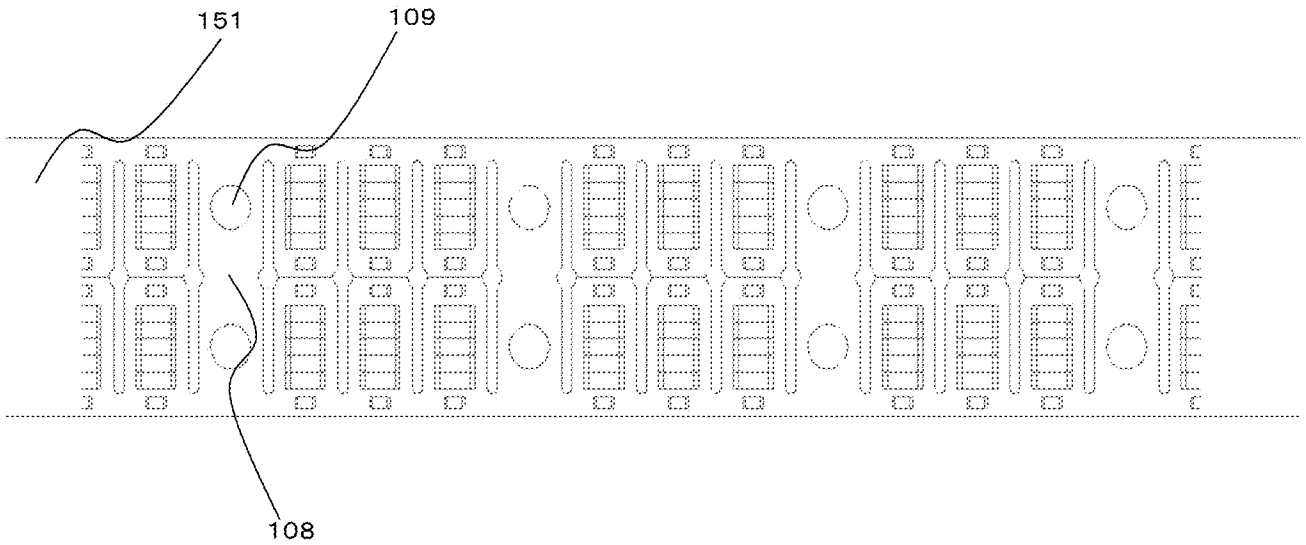
FIG. 5 is a top view of strips manufactured by a fin manufacturing apparatus according to Embodiment 2.

FIG. 5 is a top view of strips manufactured by a fin manufacturing apparatus 200 according to Embodiment 2. The fin manufacturing apparatus 200 according to Embodiment 2 includes a pilot hole forming device that is obtained by modifying the dies employed in the die device 52 described in Embodiment 1. The pilot hole forming device forms, as strips to be conveyed downstream of the progressive pressing device 51, strips 151 having a pattern of the shape illustrated in FIG. 5. In the strips 151 of this pattern, pilot holes 109 are formed in areas other than areas among the openings 103 and the cut-and-raised slits 105. The uncut portions 108 are formed in the areas in which the pilot holes 109 are formed. The pilot holes 109 may be formed in the areas among the openings 103 and the cut-and-raised slits 105.

The feed pins 65 of the feed roller 58 and the feed pins 63 of the feeding device 62 are inserted into the pilot holes 109 to convey the strips 151. Furthermore, the stack bars 64 of the stacking device 61 are inserted into the pilot holes 109 to stack the fins 102 formed by cutting the strips 151 using the inter-row cutting device 59 and the cutoff device 60. In the present disclosure, the pilot hole 109 is also termed "a pilot hole for insertion of a pin for conveyance".

Employing the above-described configuration, which includes inserting the feed pins into the pilot holes 109 to convey the strips 151, leads to less probability that deformation of the strips 151 occurs than the probability that deformation of the strip 150 occurs in employing a configuration in which the feed pins are inserted into the openings 103 or the openings 104. This allows the fin manufacturing apparatus 200 to achieve more stable conveyance than in Embodiment 1. Furthermore, employing the pilot holes 109 enables easier stacking of the fins 102 on the stack bars 94 of the stacking device 61 because inserting the stack bars 64 into the pilot holes 109 each having a circular shape can be performed easier than inserting the stack bars 64 into the openings 103 or the openings 104.

Embodiment 3

Figure 6:
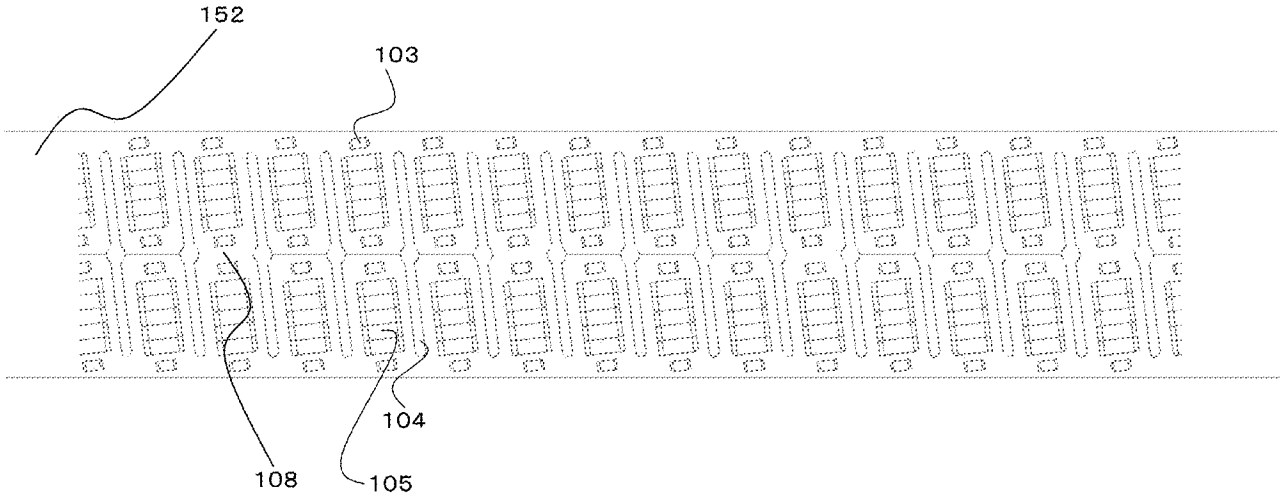
FIG. 6 is a top view of strips manufactured by a fin manufacturing apparatus according to Embodiment 3.

FIG. 6 is a top view of strips manufactured by a fin manufacturing apparatus 200 according to Embodiment 3. The fin manufacturing apparatus 200 according to Embodiment 3 includes the die device 52 that employs dies obtained by modifying the dies employed in the die device 52 described in Embodiment 1. This allows the die device 52 to form, as strips conveyed downstream of the progressive pressing device 51, strips having a planar pattern as illustrated in FIG. 6. Specifically, the shape of strips 152 is obtained by modifying the arrangement of the openings 103, the openings 104 and the cut-and-raised slits 105 of the strip 150 such that the axes thereof incline in the conveying direction.

Figure 7:
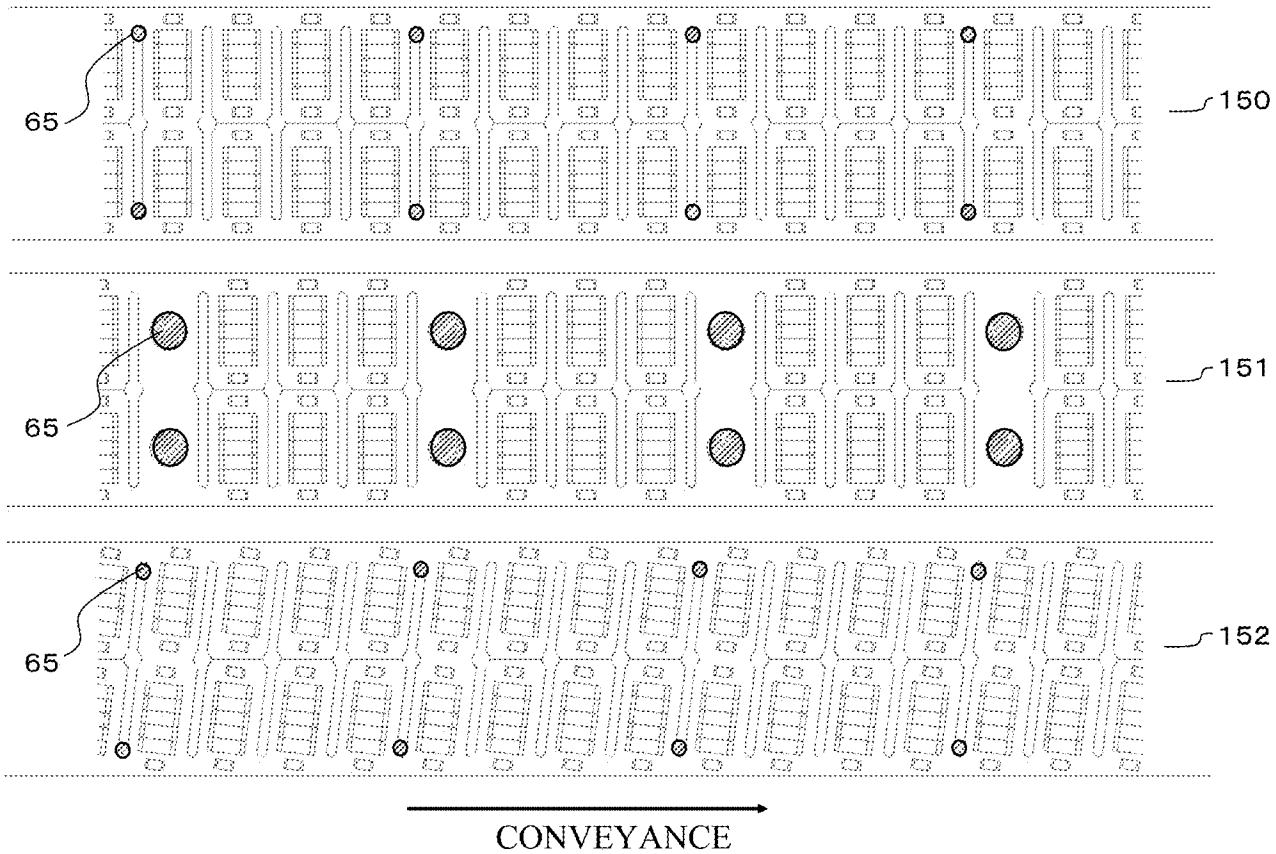
FIG. 7 is a top view of strips, illustrating arrangements of feed pins of the fin manufacturing apparatuses according to Embodiments 1, 2 and 3.

FIG. 7 illustrates a comparison of the arrangements of the feed pins 65 included in the fin manufacturing apparatuses 200 according to Embodiments 1, 2 and 3. Although the feed pins 65 are inserted into the openings 103 or the openings 104 to convey the strips 152 in Embodiment 3, arrangement of the feed pins 65 employed in Embodiment 3 is different from that employed in conveying the strips 150. Also, the arrangement of the feed pins 65 in Embodiment 2 is different from that employed in Embodiment 1. Arrangement of the feed pins 63 employed in each embodiment is to be the same as the arrangement of the feed pins 65 employed in the corresponding embodiment of FIG. 7. As illustrated in FIG. 7, the feed pins 65 are caught on the uncut portions 108 provided in the conveyance direction side of the strips and having high rigidity, thereby enabling stable conveyance.

Employing such configuration enables forming of the fins 102 that have improved water drainage and improved heating performance.

Embodiment 4

Figure 8:
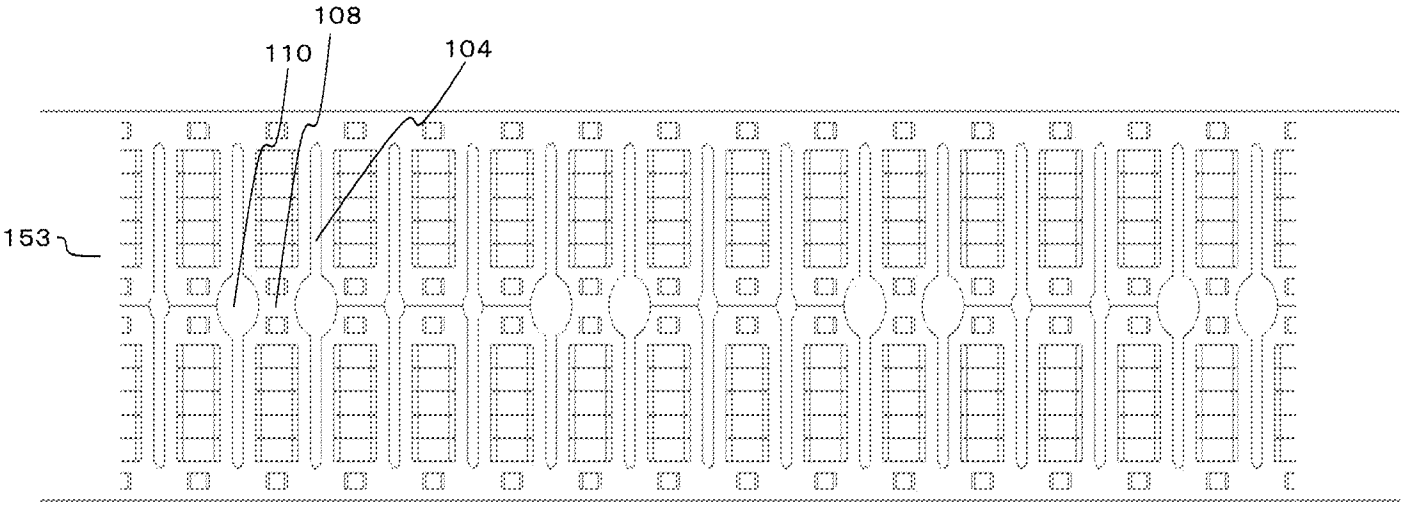
FIG. 8 is a top view of strips manufactured by a fin manufacturing apparatus according to Embodiment 4.

FIG. 8 is a top view of strips manufactured by a fin manufacturing apparatus 200 according to Embodiment 4. The fin manufacturing apparatus 200 according to Embodiment 4 includes an uncut portion shortening device obtained by modifying the dies employed in the die device 52 described in Embodiment 1. The uncut portion shortening device forms waste portions in the uncut portions such that the uncut portions 108 are relatively small. Specifically, to enlarge the R parts of the openings 104 formed on both sides of the uncut portions 108 and to form the uncut portions 108 that are smaller than those of other embodiments, blanked portions 110 are formed in strips 153, as illustrated in FIG. 8. The blanked portions 110 are not limited to the R parts and may have another shape, such as a rectangular or rhombic shape.

Employing such configuration leads to reduction of burden on the inter-row cutting device 59 in cutting the uncut portions 108, thereby prolonging working life of the fin manufacturing apparatus 200.

Embodiment 5

Figure 9:
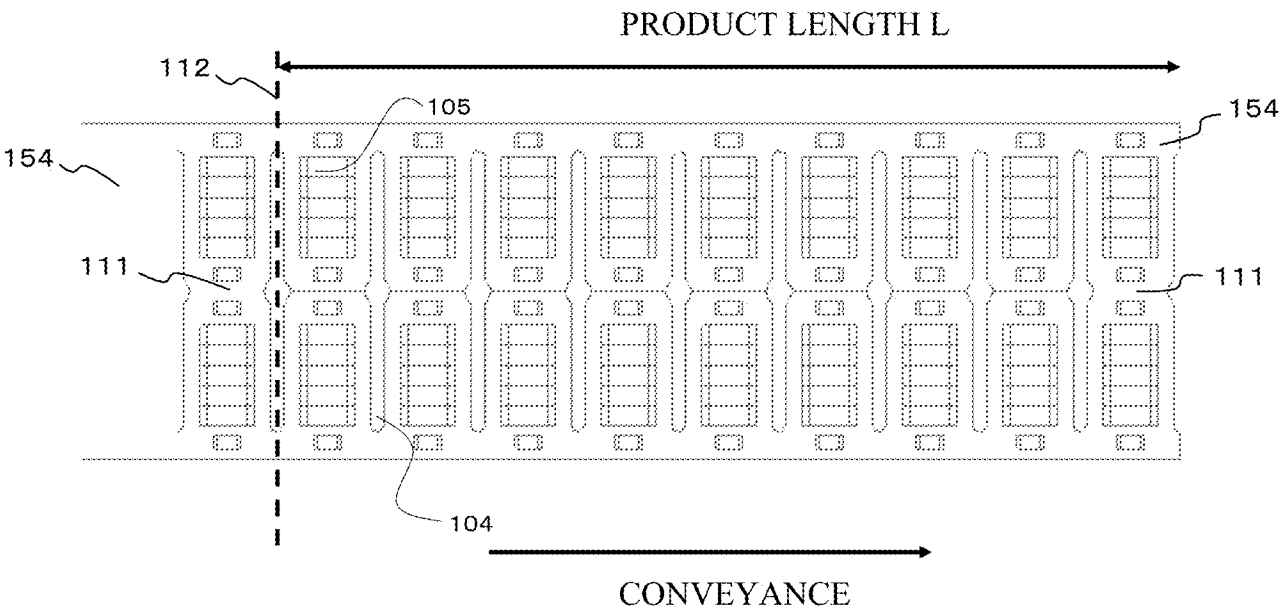
FIG. 9 is a top view of strips manufactured by a fin manufacturing apparatus according to Embodiment 5.

FIG. 9 is a top view of strips manufactured by a fin manufacturing apparatus 200 according to Embodiment 5. In the fin manufacturing apparatus 200 according to Embodiment 5, cutting performed by the inter-row slit device 53 that is the first cutting device is modified to form, only at portions of strips 154 near positions at which the strips 154 are to be cut to form pieces each serving as one fin 102, that is, only at portions of the strips 154 near heads of areas thereof that each serve as the fin 102, uncut portions 111 that are not cut by the slit 107*d*. Forming the uncut portions 111 at such portions allows the fin manufacturing apparatus 200 to maintain two strips 154 partially coupled to each other and to separate the plurality of strips 154 only by performing cutting at cutting positions 112 by use of the cutoff device 60, thereby cutting the uncut portions 111 formed near the heads by use of the inter-row cutting device 59.

Employing the above-described configuration leads to forming of the uncut portions 111 at the portions of the strips 154 near the heads of the areas that each serve as the fin, thereby enabling the strips 154 to have rigidity higher than that the single strip 154 has. This allows the fin manufacturing apparatus 200 to convey highly rigid strips 154 to immediately before the cutoff device 60. Thus, the fin manufacturing apparatus 200 can achieve stable conveyance without the occurrence of erroneous feeding. Furthermore, various conventional problems caused by erroneous feeding can be eliminated. Furthermore, cutting operation performed by the inter-row cutting device 59 of the fin manufacturing apparatus 200 can be simplified, and thus the inter-row cutting device 59 can have simple configuration. Furthermore, the burden on the inter-row cutting device 59 in performing cutting can be reduced, and thus working life of the fin manufacturing device 200 can be prolonged.

Although the fin manufacturing apparatus 200 delimits the product length L based on the central portions of the openings 104 corresponding to the cutting positions 112 as illustrated in FIG. 9, delimitation of the product length L is not limited to the cutting positions 112, and the product length L may be delimited by, for example, the portions at which the cut-and-raised slits 105 are formed, or may be set or delimited depending on a shape and a design of the fin 102.

Furthermore, the fin manufacturing apparatus 200 according to Embodiment 5 can have simple configuration, because the fin manufacturing apparatus 200 according to Embodiment 5 cuts only one uncut portion 111 to obtain one fin 102 whereas the inter-row cutting device 59 according to the embodiments other than Embodiment 5 cuts a plurality of the uncut portions 108 to obtain one fin 102. Arranging the simplified function of the inter-row cutting device 59 in the stacking device 61 enables conveyance of, to the stacking device 61, a plurality of the strips 154 that is obtained by performing cutting at the cutting positions 112 using the cutoff device 60, has a width equal to the width of two tube-fin and is provided near the head thereof the uncut portion 111. Thus, the fin manufacturing apparatus 200 can convey the strips 154 to the stacking device 61 in a stable state.

Embodiment 6

Although the progressive pressing device 51 of the fin manufacturing apparatus 200 according to Embodiment 1 includes the inter-row slit device 53, the inter-row slit device 53 may be any other cutting device that can cut the metal plate 10 into the shape described in Embodiment 1. A fin manufacturing apparatus 300 according to Embodiment 6 is an apparatus that includes a roll cutting device 66.

Figure 10:
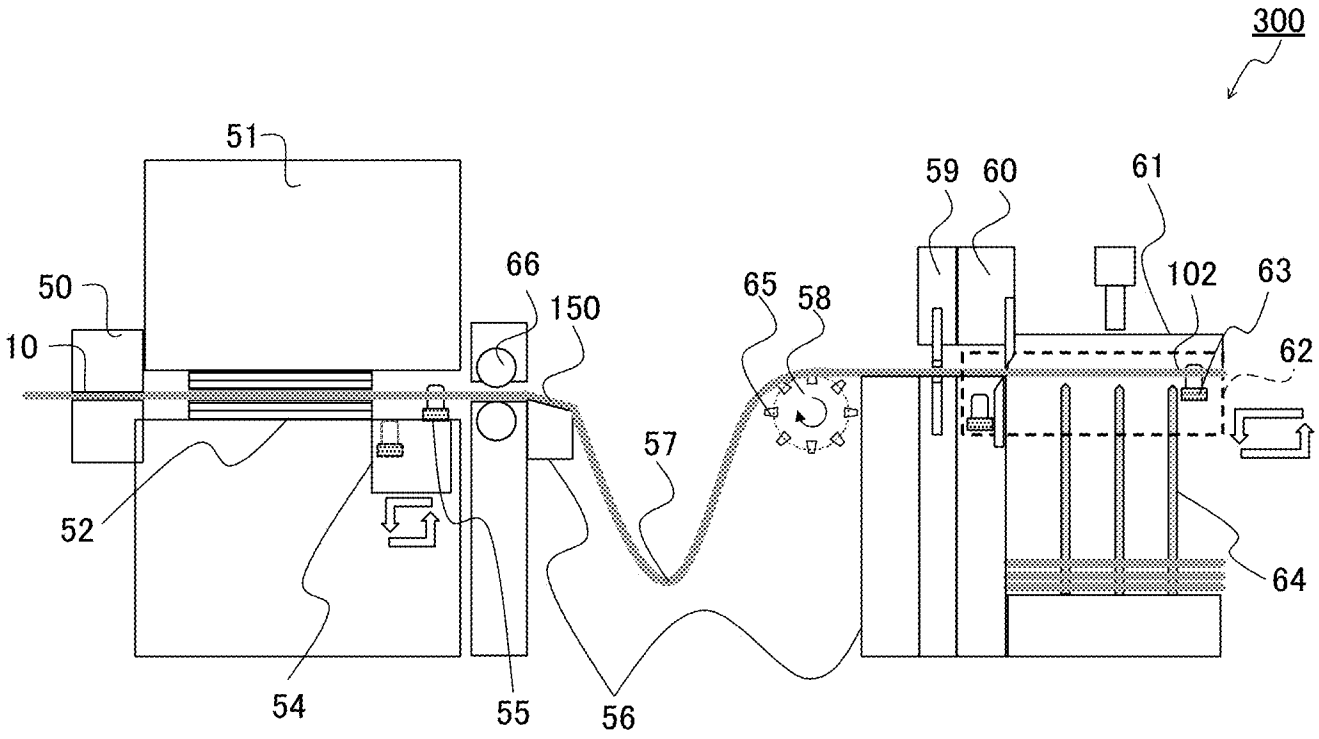
FIG. 10 is an overall view of a fin manufacturing apparatus according to Embodiment 6.

FIG. 10 is an overall view of the fin manufacturing apparatus 300 according to Embodiment 6. As illustrated in FIG. 10, the progressive pressing device 51 includes the roll cutting device 66 downstream of the die device 52.

The roll cutting device 66 performs cutting that the inter-row slit device 53 described in Embodiment 1 performs. Specifically, the roll cutting device 66 includes two roll-shaped cutting blades disposed in the vertical direction to sandwich the metal plate 10. The roll cutting device 66 rotates these cutting blades in synchrony with the operation of the progressive pressing device 51. Thus, the roll cutting device 66 cuts the metal plate 10 when portions of the metal plate 10 at which the slits 107*a* and the slits 107*d* are to be formed reach the cutting position. When portions of the metal plate 10 corresponding to the uncut portions 108 reach the cutting position, the roll cutting device 66 drives the cutting blade provided upward or downward from the metal plate 10 in the vertical direction so as not to cut the metal plate 10. As a result, the roll cutting device 66 cuts the metal plate 10 into the shape described in Embodiment 1.

The above-described configuration, which includes roll-shaped cutting blades that rotate, prevents occurrence of wear only at specific portions of the cutting blades included in the roll cutting device 66. Thus, the cutting blades included in the roll cutting device 66 are less subject to wear than cutting blades that are included in the inter-row slit device 53 and in which only a specific portion is used by the inter-row slit device 53 to perform cutting. As a result, working life of the fin manufacturing apparatus 300 can be prolonged. Furthermore, the cutting blades of the fin manufacturing apparatus 300 merely rotate, and thus a driving unit that drives the cutting blades of the fin manufacturing apparatus 300 can be smaller than a driving unit included in the inter-row slit device 53. As a result, the progressive pressing device 51 of the fin manufacturing apparatus 300 can be miniaturized, and manufacturing cost can be reduced.

Although embodiments of the present disclosure are described above, these embodiments are examples, and thus the present disclosure is not limited to the embodiments. For example, the uncut portions 108 of the present disclosure are not limited to the shape, arrangement and number of the uncut portions 108 described in the above-described embodiments. Per the present disclosure, any configuration may be employed by which the progressive pressing device 51 forms a plurality of the openings 104 for tube-insertion in the metal plate 10 and forms a plurality of the slits 105 while leaving the uncut portions 108. Thus, any shape, arrangement and number of the uncut portions 108 that can achieve the configuration may be employed.

Furthermore, although the above-described embodiments describe examples in which two strips are coupled to each other via uncut portions, the uncut portions may be formed such that three strips or more are arranged in the width direction and are partially coupled to the adjacent strip via the uncut portions. Furthermore, although the above-described embodiments describe examples of forming fins from aluminum metal, the material of the fin 102 is not particularly limited to aluminum metal and may be other material that has high thermal conductivity. For example, the material may be an aluminum alloy or a carbon material.

The structure of each fin 102 is not limited to the structure described in the embodiments, and may be another structure. For example, the fin 102 may have a shape, such as the shape as illustrated in FIG. 1, in which the openings 104 do not open on a lateral side thereof.

Although a flattened tube is described as an example of the tube 101, the tube 101 may have any cross-sectional shape that allows refrigerant to flow through the inside of the tube 101. The tube 101 may have, for example, a circular, oval or polygonal cross-sectional shape.

Although an example of employing the inter-row slit device 53 and the inter-row cutting device 59 to cut the metal plate by pressing is described, any other cutting mechanism that can achieve cutting of the metal plate may be employed. For example, a cutting mechanism using a blade, a laser, or the like, may be employed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2017-249159, filed on Dec. 26, 2017, the entire disclosure of which is incorporated by reference herein.

REFERENCE SIGNS LIST

10 Metal plate
50 NC feeder
51 Progressive pressing device
52 Die device
53 Inter-row slit device
54 Feeding device
55 Feed pin
56 Guiding device
57 Buffer portion
58 Feed roller
59 Inter-row cutting device
60 Cutoff device
61 Stacking device
62 Feeding device
63 Feed pin
64 Stack bar
65 Feed pin
66 Roll cutting device
100 Heat exchanger
101 Flattened tube
102 Fin
103 Opening
104 Opening
104*a* Opening hole
104*b* Opening hole
104*c* Opening hole
105 Cut-and-raised slit
106 Pilot hole
107*a* Slit
107*d* Slit
108 Uncut portion
109 Pilot hole
110 Blanked portion
111 Uncut portion
112 Cutting position
150 Strip
151 Strip
152 Strip
153 Strip
154 Strip
200, 300 Fin manufacturing apparatus
W1 Width

The invention claimed is:

1. A fin manufacturing apparatus for manufacturing fins for attachment to a tube provided with a refrigerant flow path, the fin manufacturing apparatus comprising:

a first cutting device to form, by forming in a plate body having thermal conductivity a plurality of openings for tube-insertion and a plurality of slits while leaving uncut portions, strips that each have openings of the plurality of openings along a longitudinal direction of the strips and are partially coupled to each other in a width direction;

a second cutting device to separate, by cutting the uncut portions via which the strips are coupled to each other, the strips such that each strip has a width of the fin;

a cutoff device to cut the separated strips that each have the width of the fin to a predetermined length; and a conveying device to convey, from the first cutting device to the second cutting device, the plurality of strips that are partially coupled to each other in a width direction, wherein the first cutting device is configured to form the plurality of slits such that the slits extend in the longitudinal direction of the strips, arrange the plurality of slits in the longitudinal direction of the strips, and form the uncut portions among the plurality of slits that are arranged in the longitudinal direction of the strips;

the second cutting device is configured to cut the uncut portions in the longitudinal direction of the strips; and the conveying device is configured to convey, in the longitudinal direction of the strips, the plurality of strips that are partially coupled to each other in a width direction.

2. The fin manufacturing apparatus according to claim 1, wherein the first cutting device includes an opening forming device to form, at positions extending across the strips that are partially coupled to each other in the width direction and not extending to both outmost sides of the coupled strips, the plurality of openings for tube-insertion.

3. The fin manufacturing apparatus according to claim 1, wherein the first cutting device includes a pilot hole forming device to form, in the plate body having thermal conductivity, a pilot hole for insertion of a pin for conveyance.

4. The fin manufacturing apparatus according to claim 1, wherein the first cutting device includes roll-shaped blades.

5. The fin manufacturing apparatus according to claim 2, wherein the opening forming device is configured to form the plurality of openings such that axes thereof incline at a predetermined angle with respect to the longitudinal direction of the strips.

6. The fin manufacturing apparatus according to claim 1, wherein the first cutting device includes an uncut portion shortening device to form openings in the uncut portions provided among the slits.

7. The fin manufacturing apparatus according to claim 1, wherein the first cutting device is configured to cut the plate body such that the uncut portions are provided at positions near heads of areas of the plate body that each are to serve as the fin.

8. The fin manufacturing apparatus according to claim 1, further comprising:

a guiding device disposed between the first cutting device and the second cutting device to guide and supply, to the second cutting device, the strips that are partially coupled to each other in the width direction, are arranged in the width direction, and are conveyed in the longitudinal direction.

9. A fin manufacturing method for manufacturing fins for attachment to a tube provided with a refrigerant flow path, the fin manufacturing method comprising:

forming, by forming in a plate body having thermal conductivity a plurality of openings for tube-insertion and a plurality of slits while leaving uncut portions, strips that each have openings of the plurality of openings along a longitudinal direction of the strips and are partially coupled to each other in a width direction wherein the plurality of slits extend in a longitudinal direction of the strips;

conveying the plurality strips that are partially coupled to each other in the width direction in the longitudinal direction of the strips;

separating, by cutting the uncut portions via which the strips are coupled to each other in the longitudinal direction of the strips, the strips such that each strip has a width of the fin; and cutting the separated strips that each have the width of the fin to a predetermined length.

10. A fin manufacturing apparatus for manufacturing fins for attachment to a tube provided with a refrigerant flow path, the fin manufacturing apparatus comprising:

a first cutting device to form, by forming in a plate body having thermal conductivity a plurality of openings for tube-insertion and a plurality of slits while leaving uncut portions, strips that each have openings of the plurality of openings along a longitudinal direction of the strip and are partially coupled to each other in a width direction;

a second cutting device to separate, by cutting the uncut portions via which the strips are coupled to each other, the strips such that each strip has a width of the fin; and a cutoff device to cut the separated strips that each have the width of the fin to a predetermined length, wherein the first cutting device includes roll-shaped cutting blades.

11. A fin manufacturing apparatus for manufacturing fins for attachment to a tube provided with a refrigerant flow path, the fin manufacturing apparatus comprising:

a first cutting device to form, by forming in a plate body having thermal conductivity a plurality of openings for tube-insertion and a plurality of slits while leaving uncut portions, strips that each have openings of the plurality of openings along a longitudinal direction of the strip and are partially coupled to each other in a width direction;

a second cutting device to separate, by cutting the uncut portions via which the strips are coupled to each other, the strips such that each strip has a width of the fin;

a cutoff device to cut the separated strips that each have the width of the fin to a predetermined length; and a guiding device disposed between the first cutting device and the second cutting device to guide and supply, to the second cutting device, the strips that are partially coupled to each other in the width direction, are arranged in the width direction, and are conveyed in the longitudinal direction.

12. The fin manufacturing apparatus according to claim 11, wherein the first cutting device includes an opening forming device to form, at positions extending across the strips that are partially coupled to each other in the width direction and not extending to both outmost sides of the coupled strips, the plurality of openings for tube-insertion.

13. The fin manufacturing apparatus according to claim 11, wherein the first cutting device includes a pilot hole forming device to form, in the plate body having thermal conductivity, a pilot hole for insertion of a pin for conveyance.

14. The fin manufacturing apparatus according to claim 11, wherein the first cutting device includes roll-shaped blades.

15. The fin manufacturing apparatus according to claim 12, wherein the opening forming device is configured to form the plurality of openings such that axes thereof incline at a predetermined angle with respect to the longitudinal direction of the strips.

16. The fin manufacturing apparatus according to claim 11, wherein the first cutting device includes an uncut portion shortening device to form openings in the uncut portions provided among the slits.

17. The fin manufacturing apparatus according to claim 11, wherein the first cutting device is configured to cut the plate body such that the uncut portions are provided at positions near heads of areas of the plate body that each are to serve as the fin.

* * * * *